US009169048B2

(12) United States Patent
Ludewigs et al.

(10) Patent No.: US 9,169,048 B2
(45) Date of Patent: Oct. 27, 2015

(54) HINGED CLOSURE

(75) Inventors: Werner Ludewigs, Emden (DE); Ingolf Steinhagen, Bunde (DE); Michael Schipper, Weener (DE); Hartmuth Timmer, Weener-Holthusen (DE)

(73) Assignee: Weener Plastik GmbH, Weener (DE)

( * ) Notice: Subject to any disclaimer, the term of this patent is extended or adjusted under 35 U.S.C. 154(b) by 668 days.

(21) Appl. No.: 12/466,794

(22) Filed: May 15, 2009

(65) Prior Publication Data

US 2010/0170910 A1 Jul. 8, 2010

(30) Foreign Application Priority Data

Jan. 5, 2009 (DE) ..... 20 2009 000 138 U

(51) Int. Cl.
*B65D 51/04* (2006.01)
*B65D 51/00* (2006.01)
*B65D 47/08* (2006.01)

(52) U.S. Cl.
CPC .... *B65D 47/0838* (2013.01); *B65D 2251/1008* (2013.01)

(58) Field of Classification Search
CPC ..... B65D 47/0838; B65D 2251/1008; B65D 51/04; B65D 51/00
USPC ..... 215/235; 220/831, 832, 833, 834, 835
See application file for complete search history.

(56) References Cited

U.S. PATENT DOCUMENTS 5,038,957 A * 8/1991 Gross ..... 220/840
5,906,291 A * 5/1999 Mann et al. ..... 220/756
6,092,690 A * 7/2000 Bitowft et al. ..... 220/831
6,478,184 B2 * 11/2002 Berge et al. ..... 220/831
7,784,641 B2 * 8/2010 Chou ..... 220/832
2004/0195239 A1 * 10/2004 Rush et al. ..... 220/254.3
2006/0231518 A1 10/2006 Suffa
2007/0039915 A1 * 2/2007 Jackel ..... 215/235
2007/0102390 A1 * 5/2007 Hoepner et al. ..... 215/235
2007/0102391 A1 * 5/2007 Hoepner et al. ..... 215/235
2007/0138124 A1 * 6/2007 Skillin ..... 215/235
2008/0011704 A1 * 1/2008 Van Ryn ..... 215/235
2008/0169261 A1 * 7/2008 Druitt et al. ..... 215/237
2010/0170910 A1 * 7/2010 Ludewigs et al. ..... 220/810

FOREIGN PATENT DOCUMENTS

DE 84 21 061 11/1985
EP 1 319 605 A1 6/2003
FR 2 905 359 A1 3/2008
WO WO 02/098756 A2 12/2002

OTHER PUBLICATIONS

German Office Action issued on Jun. 27, 2011 in corresponding German Application No. 10 000 026.4.

* cited by examiner

*Primary Examiner* — Fenn Mathew
*Assistant Examiner* — Don M Anderson
(74) *Attorney, Agent, or Firm* — Greer, Burns & Crain, Ltd.

(57) ABSTRACT

A hinged closure for a container, particularly a drinking bottle, includes a lower part and an upper part, a hinge section, with which the upper part can be pivoted from a first position to a second position, in which the upper part is pivoted away from the lower part by an opening angle, and a retaining device, having a first retaining section and a second retaining section, both being detachably connected when the upper part is moved into the second position.

21 Claims, 8 Drawing Sheets

HINGED CLOSURE

PRIORITY CLAIM

This application claims the priority of German Application No. 20 2009 000 138.5, filed on Jan. 5, 2009.

BACKGROUND

The present invention concerns a hinged closure for a container, in particular a drink bottle, and a container equipped with such a hinged closure.

Hinged closures are being used to seal a variety of containers, in particular containers made of plastic, glass, metal as well as containers made using paper and cardboard, e.g. containers made from laminated paper foil. The containers can vary in their shape and can be designed as bottles, tubes, boxes or any other shape. Such containers serve in the food, cosmetics, pharmaceutical, chemical or packaging industry in general to store and to supply various substances. Such substances may be liquid, powdery, pasty or gel-like. In the food and packaging industry, such hinged closures are often used to seal beverage containers.

A particular desire in functional hinged closures is to be met in the supply of sports drinks producers and vendors of drinking bottles for the sports market, e.g. for cycling. A particular aspect in this respect is the demand of recyclability of such highly functional hinged closures as a mass product. Therefore, it is desirable to manufacture the hinged closures inexpensively while remaining highly functional.

One desirable function of such hinged closures, used e.g. for sealing sports drink bottles, is in particular the possibility of a comfortable, especially one-handed use. The upper part of the hinged closure should reveal the outlet located in the lower part of the hinged closure when open, and it should not, e.g. for gravitational reasons, flip back from the open position unintendedly. It is known to achieve this by applying a spring mechanism forcing the upper part of the hinged closure to remain in the open position. In addition to metal springs and elastic plastic materials it is known to use integral hinges employing an elasticity resulting from the particular hinge design. Such spring closures are often disadvantageous in that the open position of the upper part is defined unsatisfactorily and might vary during the life time of the hinge due to material fatigue.

It is the object of the present invention to introduce an improved hinged closure and a container equipped with such closure, whereby the hinged closure can in particular be manufactured inexpensively.

SUMMARY

The hinged closure according to the invention particularly for a container, e.g. a drinking bottle, comprises a lower part and an upper part, a hinge section to allow the upper part to move between a first position and a second position, in which the upper part is pivoted away from the lower part by an opening angle, and a retaining device comprising of a first and a second retaining section, both being detachably combined by pivoting the upper part into this second position.

The lower part of the hinged closure functions preferably to connect the hinged closure to the container. Therefore, the lower part preferably features means to fasten the closure to a container, such means preferably comprising a thread to screw the lower part to a container or a container neck and in particular comprising an internal thread, suitable to be screwed to the external thread of a container neck. The lower part preferably comprises a hollow-cylindrical exterior wall, this exterior wall preferably being concluded by a sealing wall in the upper part. This sealing wall comprises an outlet. Preferably, a hollow-cylindrical outlet port extends downwards from this outlet.

The lower part's sealing wall preferably comprises an aperture area, the outlet thereby opening out into that aperture area. The aperture area is preferably formed as a hollow nozzle extending upwards from the sealing wall. An exterior wall of the aperture area preferably comprises a concave-shaped profile, particularly advantageous in its use as a drinking nipple, where an ergonomic shape, particularly an edgeless design, is essential. The outlet or the outlet port of such an aperture area can function as a metering or portioning nozzle, particularly by dimensioning the opening diameter appropriately, the particular design thereby allowing an exact measurement of the content.

Furthermore, the lower part preferably comprises on its reverse side an inner hollow cylinder extending preferably from the reverse side of the sealing wall into the interior of the lower part. This inner hollow cylinder is preferably formed to engage with the container neck and to shape a sealing contact, in particular a fluid-proof contact, between its exterior side and the interior side of the container neck. Between the exterior side of this inner hollow cylinder and the interior side of the hollow-cylindrical side wall of the closure's lower part preferably several, particularly preferably at least three and preferably five to ten, preferably eight, protruding elements are formed, extending inward from the interior side of the lower part's hollow-cylindrical side wall. These protruding elements are preferably shaped to fix the upper area of a container neck by clamping it between the inner cylinder and the lower part's side wall while screwing the lower part with its thread to a corresponding container neck, thereby allowing for a strong connection of the lower part to the container.

Also, it is possible and preferred to include additional means to fix the lower part to a container or to a container neck, e.g. protruding cams or slant fin elements on the lower part's interior, preventing or hindering the lower part from being screwed-off the container neck by jamming with corresponding abutment elements.

The upper part of the hinged closure is preferably shaped as a cover, at least covering, preferably sealing, particularly dust-proof, fluid-proof or gas-proof, the outlet in the closed status of the hinged closure. The upper part is preferably formed as a cap. Preferably, it features a side wall connecting the upper part to a hinge, this hinge being connected to the lower part. The upper part's side wall is preferably designed hollow-cylindrical or at least featuring a circular edge preferably fit to that of the exterior wall of the lower part's sealing wall. Preferably, the lower edge of the upper part's side wall and the outer edge of the sealing wall, functioning as a contact area for the upper part, are designed form-fit to achieve a certain sealing effect. However, it is possible and preferred, that the upper part has only a weakly formed side wall or no side wall at all, its base side areas being designed essentially flat.

The upper part preferably comprises a top wall, preferably covering the outlet of the lower part when the hinged closure is in its closed position. The reverse side of this top wall preferably features a protruding element. This protruding element is preferably formed as a sealing nozzle, preferably designed to engage with and thereby seal the lower part's outlet and/or outlet port. This protruding element or sealing nozzle is particularly formed as a hollow-cylindrical component, designed to be connected preferably integrally with the reverse side of the upper part's top wall.

The outer diameter of this sealing nozzle is preferably shaped to lock with the lower part's outlet or outlet port when closing the upper part, thereby reliably holding the upper part in the closed position. Preferably, additional sealing means, e.g. an interior or exterior bulge, are provided for at the upper part's sealing nozzle or at the outlet or outlet port. Further, e.g. an exterior bulge is possible, revolving around the sealing nozzle concentrically, thereby engaging with a corresponding interior bulge on the outlet or outlet port. Also, it is possible and preferable to furnish the sealing nozzle or the outlet or outlet port with sealing means made from different materials, e.g. elastic materials such as thermoplastics.

The hinge area of the hinged closure preferably features an integral hinge. The integral hinge contains preferably at least one section, but it can also consist of two or more integral hinge sections. Further, it is possible and preferred that the integral hinge features other components allowing for the hinged closure to pivot reliably, whereby these components may include a hinge axis and an axle bearing.

The hinge closure's retaining device is advantageous in that its upper part can be attached in the open position and unintended pivoting back can thereby by prevented. Therefore, the use of such a hinged closure is highly comfortable, particularly when mounted on a drinking bottle, used e.g. while sporting. In addition, the construction of a retaining device comprising a first and a second retaining section, allows for a particularly inexpensive production of such a hinged closure.

This first retaining section is preferably located on the lower part and this second retaining section is preferably located on the upper part. Besides, it is possible and preferred to locate the first retaining section on the upper part and the second retaining section on the lower part.

In this second position the first and the second retaining sections are preferred to be loosely connectable. This connection is preferably shaped as a locking connection. This first retaining section and this second retaining section are preferably formed to allow for a locking connection. Preferably, this first retaining section and this second retaining section each contain one locking section.

This first retaining section preferably features or itself forms a protruding section. This second retaining section preferably features or itself forms an engaging section. The engaging section may also be designed partly as a protruding section. Furthermore, it is possible and preferred that this first and/or second retaining section comprise an engaging section and a protruding section, particularly shaped to complementarily interact with the other retaining section's respective partition.

This protruding section and this engaging section are preferably shaped to engage with each other, in particular by means of a locking connection. This engaging section is preferably formed as an immersion and/or opening and/or a notch in the upper or the lower part. The engaging section may as well be constructed as a pocket section, e.g. extending from the upper or lower part's exterior wall into the closure's interior. When forming a pocket section the notch or the opening of the engaging section is at least partly, possibly entirely, surrounded by a wall in at least one dimension.

By so relocating the engaging section as far as possible into the closure's interior an objectionable salience on the closure's outside can be considerably diminished or even entirely avoided. But it is possible and preferred that the engaging section at least partly protrudes to the outside. The recessing area can open the closure's interior to its ambience, thereby allowing for a venting of the closure's interior. Also, it is possible to shape this engaging section as a pocket section preferably sealing the closure's interior entirely against the engaging section's opening and thereby preventing the intrusion e.g. of dust.

The engaging section is preferably designed to lock this protrudingly formed retaining section. Preferably, this engaging section comprises at least one fin element shaped to jam with this protruding section. To this aim the protruding section may preferably be T- or L-shaped in its profile. The protruding section and the engaging section are preferably designed to lock with each other when the upper part is being pivoted into this second position. The engaging section preferably comprises a slot-like opening and the protruding section is preferably elongate in shape. Also, it is possible and preferred that this engaging section comprises more than one opening, this opening possibly having a shape other than elongate, e.g. circular, oval, rectangular or any combination of these shapes. This protruding section may furthermore comprise several ledges shaped to engage with an engaging section comprising at least one opening.

Preferably, this first retaining section and/or this second retaining section are designed at least partly elastically deformable. This may be achieved e.g. by a engaging section comprising a materially thin fin element, the elasticity thereby resulting solely from the chosen thinness of the fin and essentially depending on the material of the closure itself. But it is also possible and preferred for this engaging section to feature another component made from an elastically deformable material, e.g. a thermoplastic, or to be laminated with such a material. Further, it is possible and preferred for this protruding section to comprise an elastically deformable fin and/or another component made from an elastically deformable material.

Furthermore, it is possible and preferred for this retaining section and this second retaining section to be designed to achieve a form fit and/or a tight fit connection in this second position, e.g. by means of a clamp-connection. Preferably, this first retaining section comprises a protruding section with a rough surface or a surface equipped with fins or other protruding elements, thereby allowing this protruding section to lock with this second retaining section. To this aim, this second retaining section is preferably formed as a engaging section with a rough surface or an interior comprising fins or other fit protruding elements that allow to lock the protruding section. Preferably, this engaging section and/or this protruding section are at least partly elastically deformable, thereby supporting both retaining sections to be locked through a clamp-connection.

Also, it is possible and preferred that this first retaining section comprises a hook element and that this second retaining section comprises a barbed hook element to jam both retaining sections. Thereby, it is possible to connect both retaining sections form-fittedly. It is preferred that this first and/or this second retaining section and/or this hinge section are elastically deformable, allowing both retaining sections to jam.

This first retaining section is preferably located on a first wall and this second retaining section is preferably located on a second wall of the closure. This first wall preferably is an exterior wall and this second wall preferably is an interior wall of the upper or lower part. Preferably, this first retaining section is located on one wall of the lower part and this second retaining section is located on another wall of the upper part. This first wall is preferably inclined compared to the upper or lower part's normal by a first inclination angle $\alpha 1$ and/or this upper part's second wall is preferably inclined compared to the upper or lower part's normal by an inclination angle $\alpha 2$. A normal is preferably being defined as the line standing upright on a plane level as defined by a contact surface between the upper and the lower part. Furthermore, the normal is preferably defined as the line standing upright on the lower part's top wall.

This first inclination angle $\alpha 1$ and/or this second inclination angle $\alpha 2$ preferably belong to a group of angles comprising the angles 0°-90°, 0°-45°, 0°-30°, 5°-30°, 7°-25°, 10°-20°, 10°-15° and 15°-20°. Preferably, this first and/or this second wall are shaped angular, influencing the opening angle in this second position. Preferably, this opening angle is >180°. Also, it is possible and preferred that the opening angle in this second position stems from a group of angles comprising the angles 90°-270°, 100°-235°, 150°-230°, 170°-225° and 180°-225°. By designing the closure to have a large opening angle it is achieved that preferably the upper part subtends the plane level, defined by the lower part's top wall or the contact surface, only marginally or not at all. This is particularly advantageous in that the aperture area of the lower part, that may be designed e.g. as a drinking nozzle of a drinking bottle, is largely uncovered, thereby e.g. allowing the drinking nozzle to be brought to the user's mouth conveniently.

The retaining sections are preferably located near the hinge section. Preferably, they are located nearer to the hinge section than to the lower part's reverse side or the upper part's top side when the hinge closure is closed. Also, the retaining sections can be at least partly integrated within the hinge section or can at least partly connect to the hinged closure. This vicinity is advantageous in that the upper part can be used as a lever when the closure is pivoted open, thereby connecting the first retaining section to the second retaining section through a leverage effect when the upper part is moved. Therefore, the closer the retaining sections are located to the hinge, the lesser force the user has to apply to switch the upper part into this second position. But it is also possible and preferred to locate the retaining section further away from the hinge, e.g. closer to lower part's reverse side or the upper part's top than to the hinge.

Furthermore, the hinged closure preferably comprises a tamper evidence device. By means of such a tamper evidence device it is achieved that the sealing or any violation of it is exposed to the user. Consequently, the tamper evidence device's integrity guarantees the integrity of the container sealed with the hinged closure.

Preferably, the tamper evidence device comprises a first device securing or sealing the connection between the closure's lower part and the container. This first device preferably is a snatch belt shaped to fix the lower part to the container and connected thereto through bond bridges designed as predetermined breaking zones.

Preferably, this snatch belt is a circular element connected to the lower part's bottom. Preferably, this circular element is a hollow-cylindrical element with minor height, its shape being complimentary to the lower part. If the closure's lower part is shaped essentially hollow-cylindrical, the circular element is designed essentially hollow-cylindrical as well and has a similar or identical diameter. The snatch belt can be designed as a single-part element or it can comprise two or more band segments, connected to each other e.g. by bond bridges designed as predetermined breaking zones. The snatch belt comprises, preferably on its interior, at least one protruding element extending inwards and connecting the snatch belt to the container. These protruding elements can be shaped as cams or fins, designed to lock with corresponding elements on the container or the container neck.

Furthermore, the tamper evidence device preferably comprises a second device securing or sealing the closure's position whenever the upper part rests on the lower part, hence particularly when the closure is closed. This second device preferably comprises a tear-off strap connected to the upper or lower part by means of bond bridges designed as predetermined breaking zones. Further, this second device preferably comprises a protruding section shaped to engage with this tear-off strap.

The tear-off strap preferably comprises an immersion and/or an opening and/or a cavity, each being designed to engage with this protruding section. This tear-off strap is connected preferably to the lower or the upper part by bond bridges and this protruding section correspondingly is connected either to the upper or the lower part.

To avoid elements from sticking out preferably this tear-off strap and/or this protruding section are located inwardly displaced compared to the closure's exterior wall, particularly the exterior wall of the upper and the lower part. To that aim, e.g. the upper part preferably comprises an immersion in its exterior wall, wherein this tear-off strap is located and connected to the lower part's bottom or latch by means of predetermined breaking zones. Further, the lower part preferably comprises an immersion or an opening or a cavity, where the protruding section of the tamper evidence device is located.

Furthermore, the tamper evidence device comprises preferably a locating device allowing to locate or fix the tear-off strap after it has been torn off the closure. Thereby, a separate disposal of the tear-off strap is avoided and the tear-off strap can be disposed of and recycled together with the entire closure. This locating device preferably includes an opening or an immersion or a cavity, wherein this tear-off strap can be located or fixed after being torn off, particularly by interacting with this protruding element of the tamper evidence device. Preferably, this protruding section comprises a play in the tear-off strap's opening (or immersion), particularly in the vertical direction, allowing for the tear-off strap to fall into the opening or immersion of the locating device after it has been torn off. By means of so relocating the tear-off strap's position in the sealed and unsealed state it is achieved that a breaking of the seal, or its intactness respectively, is clearly recognized by the user.

Preferably, this second device of the tamper evidence device is situated opposite of the closure's hinge. This allows for the construction elements in this second device to be designed to ease the closure's opening through the user. For example, the immersion, where the tear-off strap is located in the sealed state, can be designed as a hutch to assist the manual opening of the closure. But also, it is possible and preferred that this second device is not located opposite of the hinge but, e.g., to its side.

The hinged closure and its elements are preferably made from a thermoplastic particularly fit for injection moulding. This plastic is preferably polypropylene (PP) but other materials are possible as well.

The applicant reserves to also claim legal protection for the procedure of manufacturing the hinged closure according to the invention, particularly this lower part, this upper part, this hinge section and these retaining sections, each preferably formed integrally. This is preferably achieved through injection moulding. The procedure of manufacturing the hinged closure preferably includes the step of producing, particularly integrally moulding, the upper part and the hinge-wise connected lower part in an open position, swung open by 180°.

BRIEF DESCRIPTION OF THE DRAWINGS

Additional advantages, attributes and possibilities of application of the present invention derive from the subsequent description of the application example in combination with the drawings. Identical parts are referred to with essentially identical signs in the drawings to avoid repetitive descriptions.

DETAILED DESCRIPTION

Figure 1:
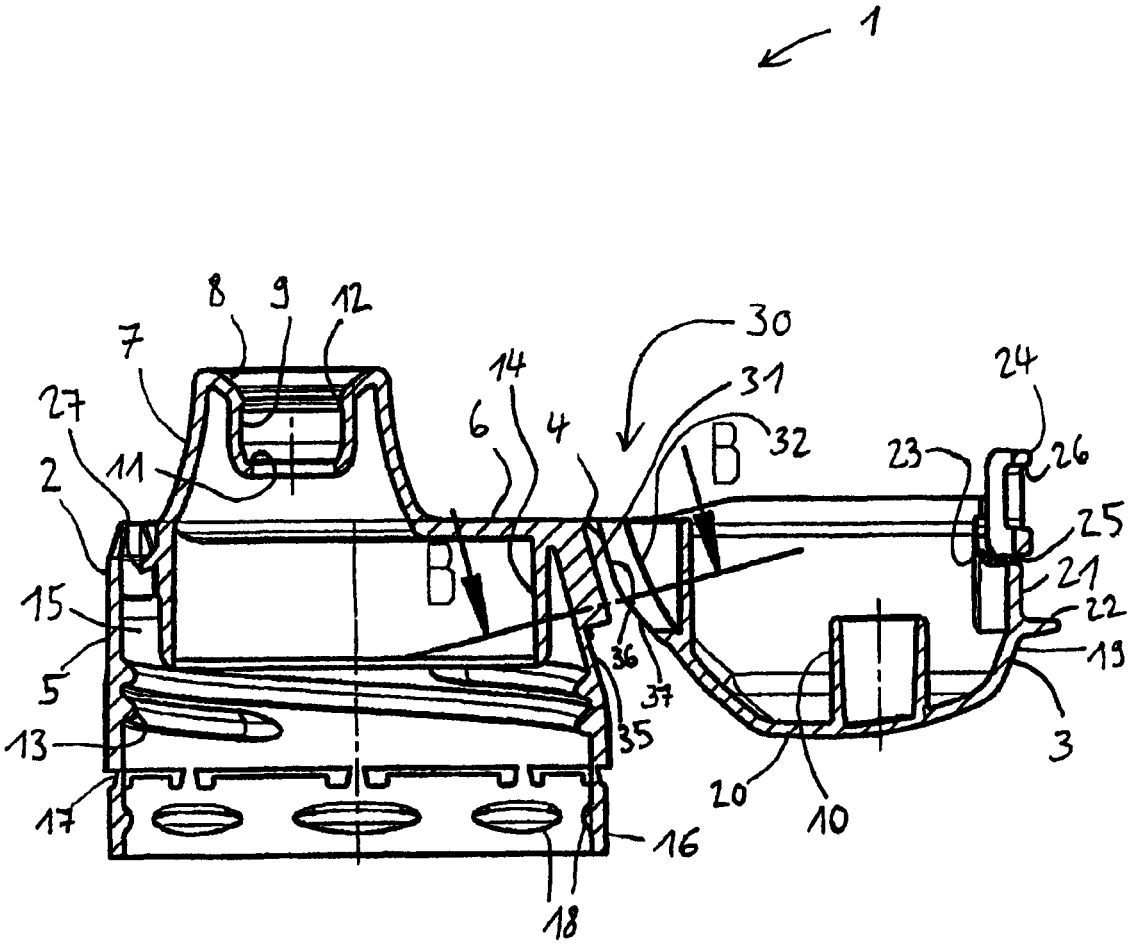
FIG. 1 shows a cross-section of the hinged closure according to the invention in an application example and in a position, in which the upper part is pivoted away from the lower part by 180°.

FIG. 1 shows the hinged closure 1. In the shown position the upper part 3 is swung open from the lower part 2 by means of the hinge 4 by 180°. The lower part 2 is an element essentially hollow-cylindrical with a hollow-cylindrical side wall 5 concluded to its upper part by a top wall 6 of the lower part 2. In the top wall 6 there is an aperture area 7 of the lower part.

The aperture area 7 opens out into the lower parts's outlet 8. Within the aperture area the hollow-cylindrical element 9 forms an outlet port. Furthermore, this hollow-cylindrical element 9 is shaped to engage with a sealing nozzle 10 of the upper part. The hollow-cylindrical element 9 further comprises an inner ring section 11, presently shaped as a hollow-cylindrical wall radially narrowing to the inside. When the hinged closure is closed, the lower edge of the sealing nozzle 10 is salient to the inner ring 11. Thereby a sealing is achieved. Such sealing is achieved additionally through the ring-shaped interior bulge 12 within the upper part of the hollow-cylindrical element 9. Furthermore, this interior bulge 12 is preferably shaped to establish a locking connection of the sealing nozzle 10 to the hollow-cylindrical element 9 when the hinged closure is closed. Preferably, the hinged closure comprises additional connection means, e.g. snapping or clinching elements, by means of which the upper part is locked resolvably to the lower part when the hinged closure is closed.

The exterior wall of the aperture area 7 comprises a concave shape in its cross-section. Together with the rounded shape of the wall elements surrounding outlet port and the round-shaped transition to the lower part's top wall 6 this aperture area 7 is designed as a drinking nozzle, allowing for a comfortable use of the hinged closure as a closure for a drinking bottle. Through an appropriate choice of the inner diameter of the opening port 8, the hollow-cylindrical element 9 or the inner ring section 11 the flow from the hinged closure can be metered and affected in its volume. Thereby, the aperture area 7 can be designed as a metering nozzle. This is particularly advantageous for applications of the hinged closure where a precise metering of the content is essential, e.g. in the cosmetic or pharmaceutical application of cremes or fluids or by applying food or toothpaste.

The lower part 2 comprises an internal thread 13, by means of which the hinged closure can be mounted on a container neck comprising a corresponding external thread.

Furthermore, the lower part 2 comprises an essentially hollow-cylindrically shaped element 14 on the lower part of its top wall 6, extending downwards from the inner side of the top wall 6. An essentially hollow-cylindrically shaped immersion 15 is formed between this element 14 and the exterior wall 5 of the lower part 2. Preferably, this immersion 15 can take in the container neck's upper part and it is preferably shaped to lock or connect the lower part 2, and thereby the hinged closure itself, to the container neck. A locking connection can be supported particularly by locating several noses on the inside of the exterior wall 5 of the lower part 2, near the hollow-cylindrical element 14, and extending radially to the inside, locking the container neck between these noses and the cylindrical element 14 when the closure is mounted to the container. Particularly by means of this, a fluid proof sealing of the container's inside to the hollow-cylindrical element 14 and thereby the lower part 2 is achieved.

At the bottom edge of the lower part 2 a snatch belt 16 is connected breakably to the lower part through several bond bridges 17 designed as predetermined breaking zones. The snatch belt 16 comprises an essentially hollow-cylindrical shape and essentially the same diameter as the lower part 2 in its lower area. The tear-off strap's height is comparatively low, presently only ⅓ of the height of the lower part 2. Noses 18 are located on the interior side of the snatch belt 16, functioning to fix the snatch belt to the container or the container neck. The noses 18 of the hinged closure can catch with barbed hooks of the container or container neck. Screwing off the closure or its lower part from the container neck then causes the snatch belt 16 to be caught by its noses 18 in this barbed position on the container while the lower part is being screwed off upwards, causing the bond bridges to break. The broken bond bridges or the falling down of the snatch belt warn the user that the sealed closure has been broken.

FIG. 1 furthermore shows the upper part 3, designed as a hinged closure connected to the lower part through a hinge 4. This hinged closure is essentially shaped as a cap, covering the outlet port 8 when the hinged closure is closed. The cap-shaped upper part 3 comprises an exterior side wall 19 merging upwards—downwards when open as shown in FIG. 1, respectively—into a ceiling wall 20. This ceiling wall 20 is designed to comprise on its bottom side a hollow-cylindrical element, shaped as a sealing nozzle and extending inwards. When the hinged closure is closed, the sealing nozzle 10 engages with the hollow-cylindrical element 9 in the aperture area 7 of the lower part 2, thereby locking preferably dust- or fluid proof.

As further shown in FIG. 1, the side wall 19 of the upper part 3 is designed to have an immersion 21, which—together with the protruding element 22—shapes a hutch for the manual opening of the hinged closure. Within this immersion 21 the side wall of the upper part 3 comprises a cavity 23 (FIG. 5), the tear-off strap 24 of the tamper evidence device being located thereunder. The tear-off strap 24 is connected removably to the upper part 3 within this cavity below the edge of the exterior wall 19 by three bond bridges 25, these being designed as predetermined breaking zones.

Figure 5:
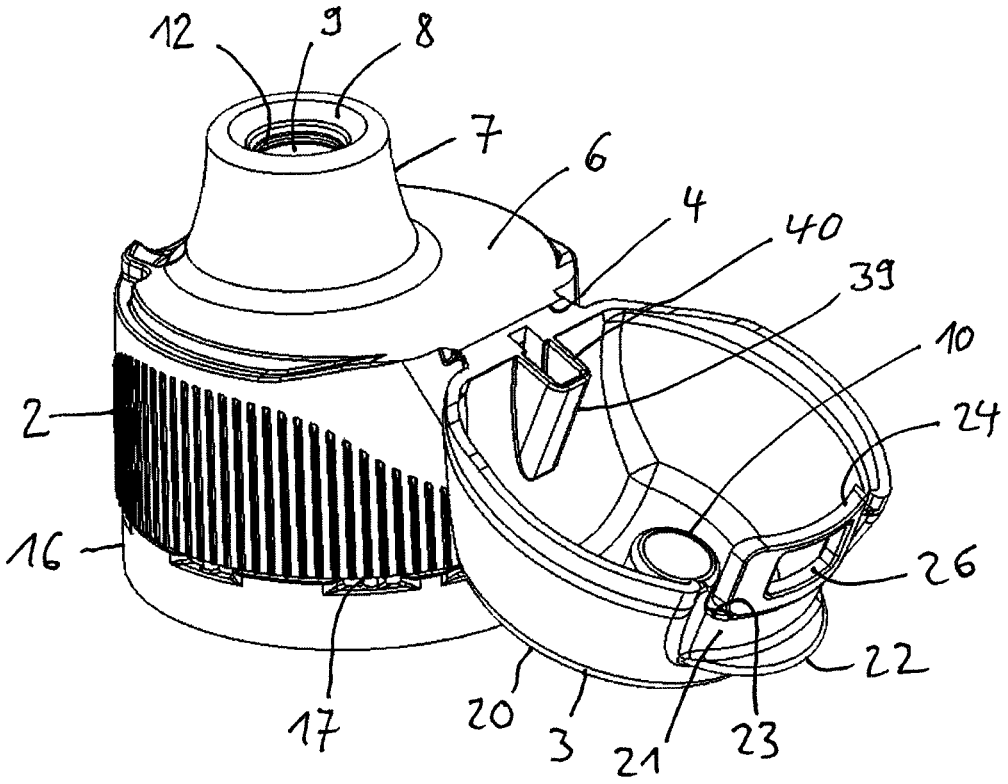
FIG. 5 shows the hinged closure as shown in FIG. 4 in the second position, in which the upper part is pivoted away from the lower part by an opening angle and the upper part is being held through a retaining section.
Figure 6:
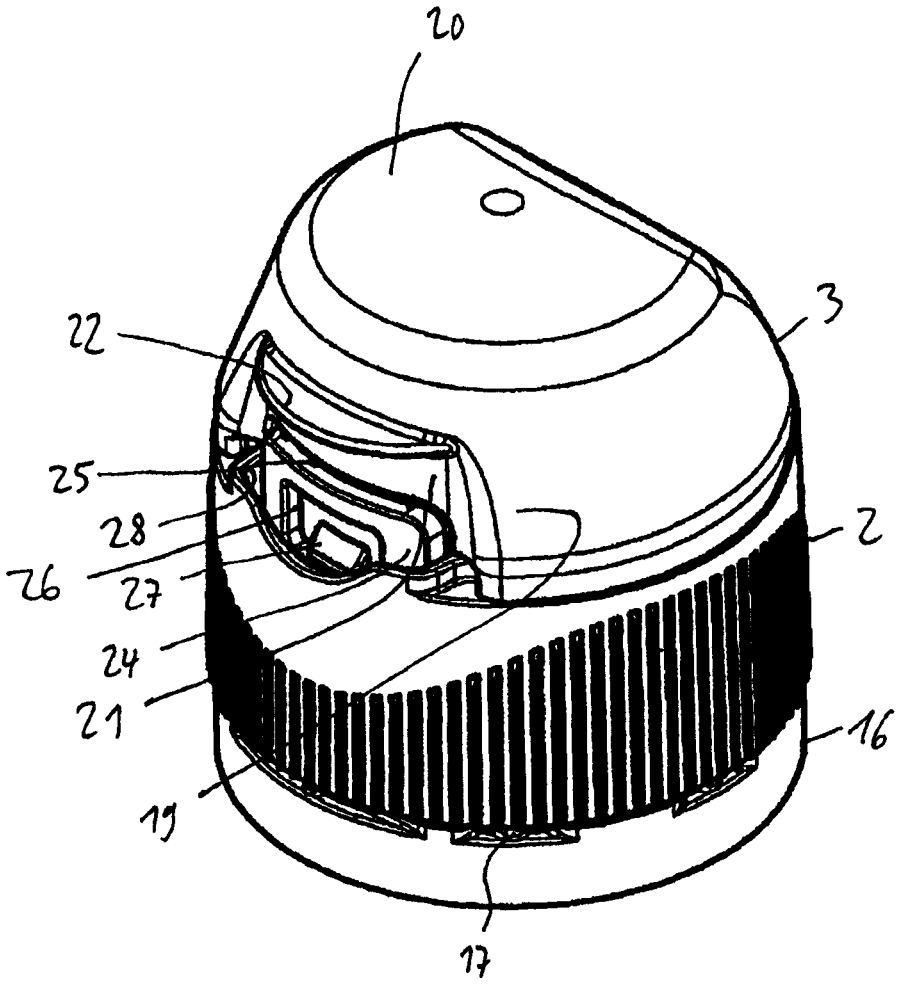
FIG. 6 is a corrected front view of the hinged closure as shown in FIG. 4.
Figure 7:
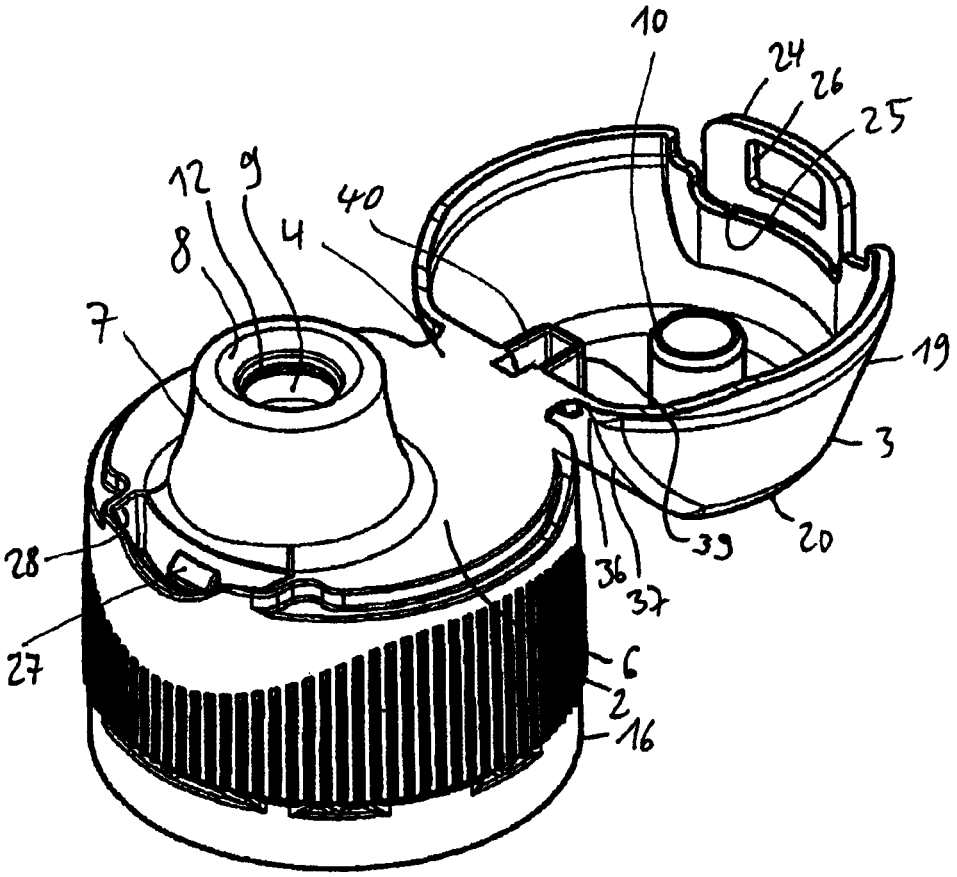
FIG. 7 is a corrected view of the hinged closure as shown in FIG. 1 in the position of FIG. 1.
Figure 8:
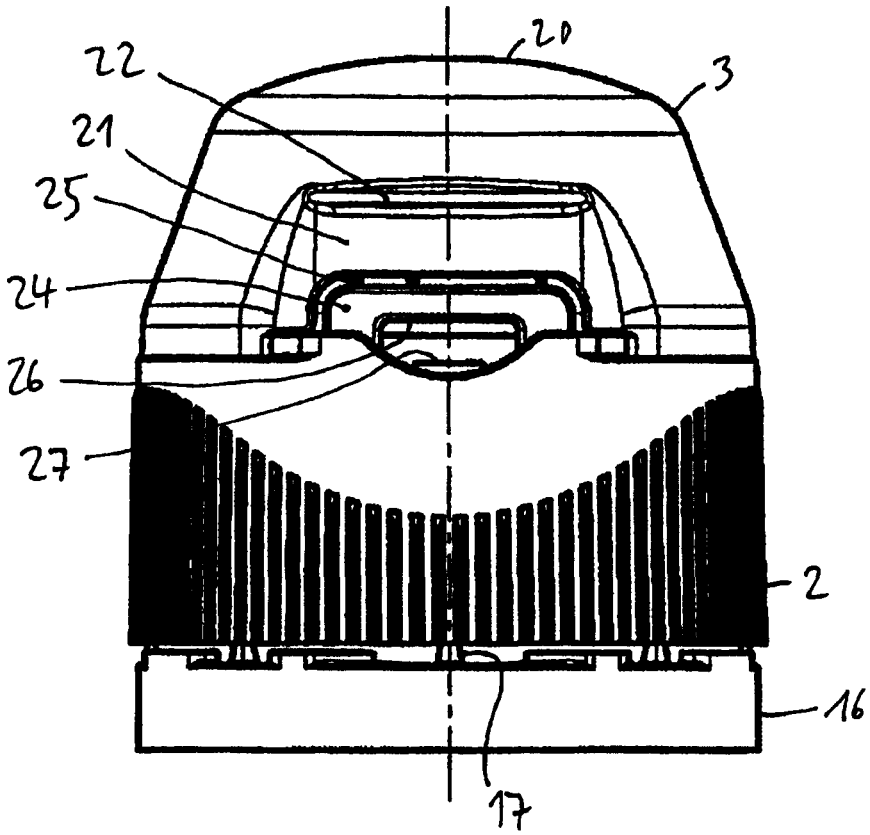
FIG. 8 is a front view of the hinged closure as shown in FIG. 3.

As shown in FIGS. 5-7, the tear-off strap 24 is an element essentially O-ring-shaped, comprising a curve fit to the curve of the upper part's wall 19. The tear-off strap 24 comprises an opening 26, engaging with a protruding section 27 with a comparatively high vertical slackness when the closure is closed and sealed. When the closure is closed and sealed the tear-off strap 24 furthermore engages with an opening 28 of the lower part as shown in FIGS. 6 and 7. The tear-off strap 24 is torn off the upper part 3 when the sealed closure is being opened, thereby falling into the opening 28 of the lower part after being torn off, and held there by its form-fitness to the opening 28 and through the protruding element 27 in such a way that it remains connected to the lower part when used ordinarily. As shown in FIG. 1, the protruding element 27 comprises a wedge profile, this wedge possibly being hook-shaped. This supports the connection of the tear-off strap 24 and its tearing off when the sealed closure is being opened.

FIG. 1 furthermore shows a line B-B, crossing the hinged closure's retaining device 30, this retaining device comprising the first retaining section 31 at the lower part and the second retaining section 32 at the upper part. This retaining device is explained in the following.

Figure 2:
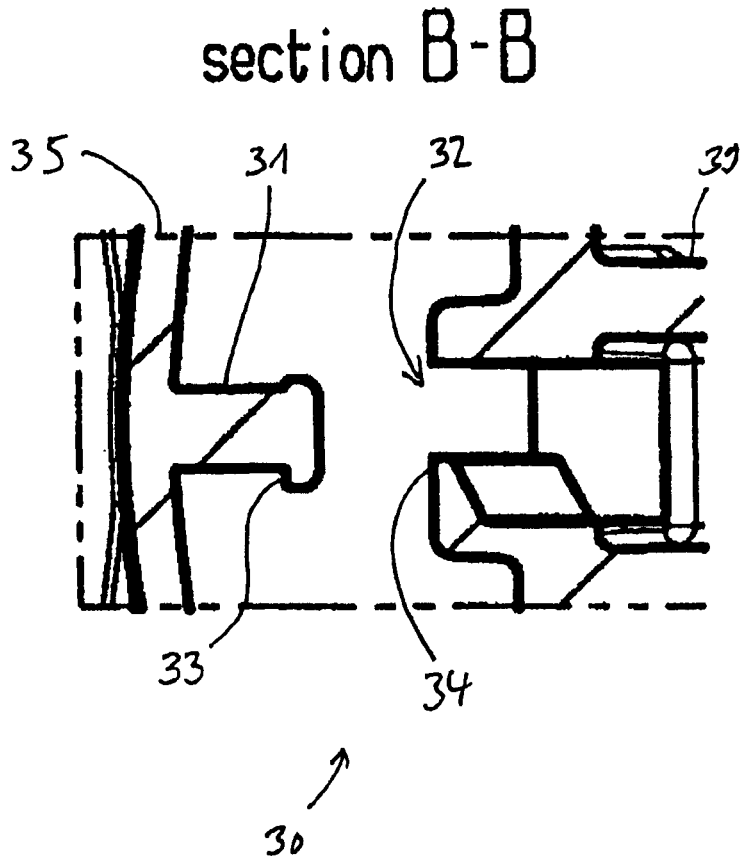
FIG. 2 shows a detail of the cross-sectional view along the line B-B in FIG. 1.
Figure 3:
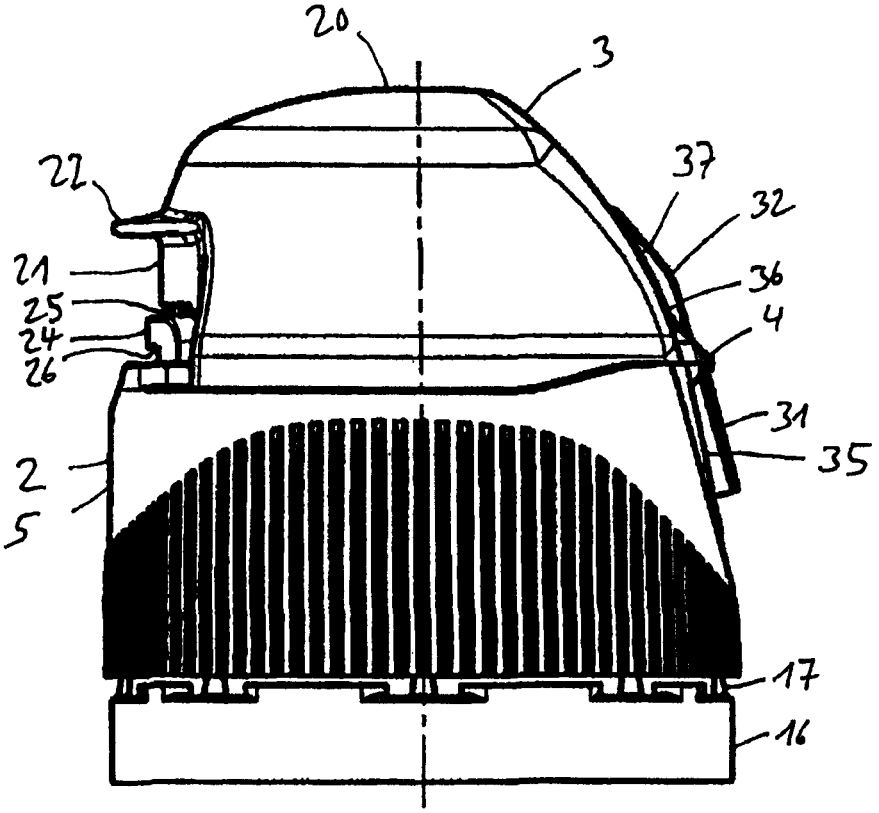
FIG. 3 shows the hinged closure as shown in FIG. 1 in a side view and in a position in which the hinged closure is closed and sealed.

FIG. 2 shows a detail of the cross-section through the hinged closure (FIG. 1) along the line B. The first retaining section 31 of the retaining device 30 is connected integrally to the lower part 2 on a first wall 35 of its side wall 5. The second retaining section 32 is connected to the upper part 3 on a second wall 36, 37 of its side wall 19. The first wall 35 comprises an inclination angle of approximately 12° as compared to the closure's normal. The upper part's second wall comprises an angle of approximately 12° as compared to the closure's normal in an area near the hinge 36 and an inclination angle of approximately 45° to the closure's normal in an area of the wall 37 neighbouring the hinge area 36. This tangential deviation of the closure's walls allows a comparatively wide opening of the closure. In the application example, the closure can be opened more than 180° in this second position, where the upper part is connected to the lower part by the retaining device. Thereby, the drinking nozzle 7 of the lower part can be easily accessed by the user. This second position of the hinged closure is shown in FIG. 5, the opening angle thereby being greater than 180°.

FIG. 2 shows the first retaining section 31 being a protruding section, extending outwards from the first wall 35 of the lower part's side wall 5. As shown in FIG. 1, this protruding section 31 is extending longitunal in its vertical direction. The cross-section in FIG. 2 shows that the protruding element is T- or L-shaped, the protruding element 31 comprising a smaller protruding element 33 extending sideward from the protruding element 31.

Figure 4:
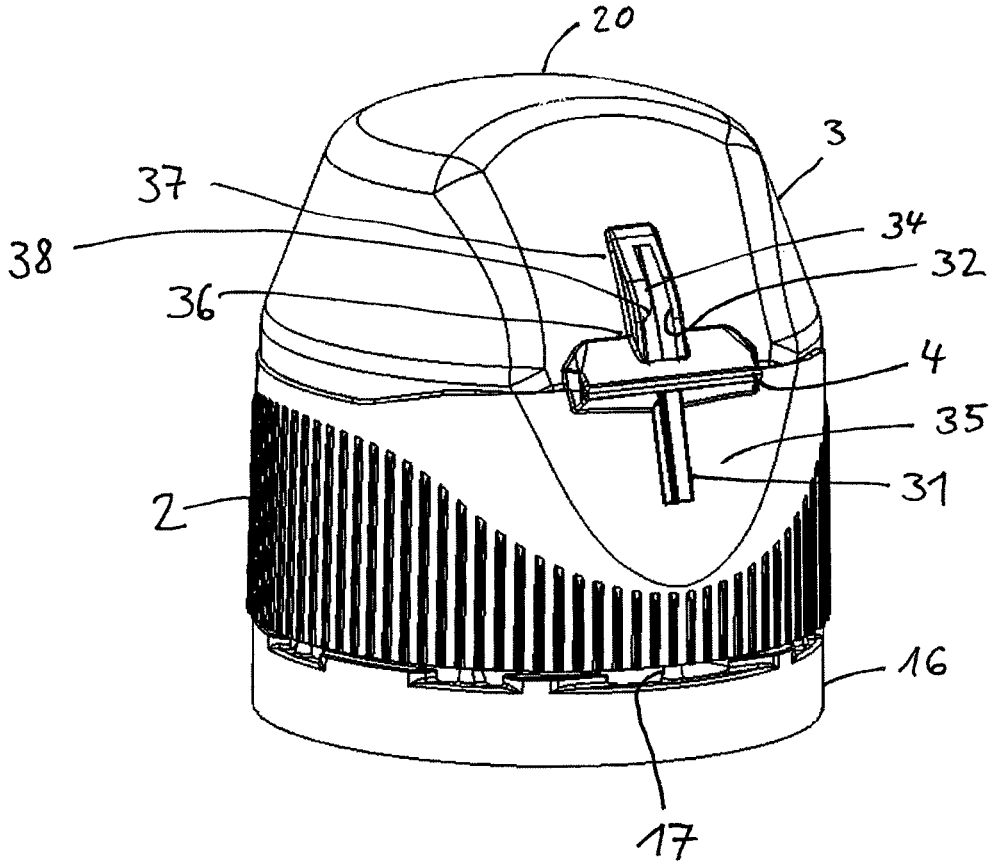
FIG. 4 shows the hinged closure as shown in FIG. 3 in a corrected back view.

The second retaining section 32 is protruding marginally from the exterior wall 36, 37 of the side wall 19 and designed as an essentially slot-shaped, vertical immersion in the side wall 19 of the upper part 3 (FIGS. 2 and 4). FIG. 4 shows that this immersion is wider in the lower wall area 36 than in the upper wall area 37, where this immersion is narrowed by fin section 34. This fin section 34 itself narrows outward and in its end comprises a comparatively low thickness, thereby causing elasticity.

FIG. 2 shows the retaining device in the position shown in FIG. 1, where the closure is opened by 180°. In this position, the first retaining section 31 does not engage with the retaining section 32. If the upper part is pivoted over the 180°-position into this second position, the fin section 34 of the second retaining section 32 is pressed against the protruding area 31 of the lower part around the bevel 38 of the fin area 34. The fins area's elasticity thereby allows the protruding section 31 to slide into the slot-shaped immersion of the second retaining section. The hook-shape of the protrusions 33 and 34 of the first and the second retaining section prevent the unintended or automatic pivoting back of the upper part by locking it in this second position. Such an unintended pivoting back particularly occurs with some of the known hinged closures when the upper part swings back from a desired open position to another position through gravitation or a reset force resulting from an elastic hinge.

Particularly FIGS. 5 and 7 show that the immersion of the second retaining section 32 is designed as a pocket section, the immersion being limited by a surrounding wall 39. In this pocket section's border area 40 the wall 39 rests on the lower part's top wall 6 when the closure is closed, resulting in an outward sealing of the upper part's interior by the wall 39. But it is also possible and preferred to omit this wall 39 of the pocket section and to design this second pertaining section essentially as an opening in the side wall 19. In this case, the interior area of the upper part 3 would be open to the closure's ambience when it is closed, thereby causing a ventilation and a drying of the aperture area, which would reduce unsanitary germ formation.

The first retaining section 31, designed as a protruding section, and the second retaining section 32, designed as an opening or immersion, are advantageous in that both may be designed integrally with the closure, afford little material and thereby allow to inexpensively realise an interlock of the upper part with the lower part when the closure is open.

What is claimed is:

1. A hinged closure for a container, particularly a drinking bottle, comprising:

a lower part and an upper part;

a hinge section, by means of which the upper part can be pivoted from a first position to a second position, in which the upper part is pivoted away from the lower part by an opening angle; and a retaining device, comprising a first retaining section and a second retaining section, both being detachably connected when the upper part is moved into said second position, wherein said first retaining section is situated on the lower part and comprises a protruding section and said second retaining section is situated on the upper part and comprises an engaging section, said protruding section having a length extending longitudinally in a vertical direction along an outer surface of said lower part and a width extending horizontally along the outer surface of said lower part, said protruding section and said engaging section being shaped to engage each other, and said length being greater than said width of said protruding section, said engaging section being configured as a pocket section in the upper part, wherein said pocket section extends from an exterior wall of the upper part into an interior space defined by the closure, said pocket section being defined by a surrounding wall and extending to a bottom edge of the upper part such that the bottom edge of the wall defining the pocket section rests on a top wall of said lower part when the closure is closed, resulting in an outward sealing of the upper part's interior by the surrounding wall.

2. The hinged closure according to claim 1, wherein at least one of said retaining sections cause a resistance of the upper part to move back from said second position into said first position.

3. The hinged closure according to claim 1, wherein said first retaining section and said second retaining section are designed to achieve a lock connection and wherein particularly said first and said second retaining sections each comprise a lock section.

4. The hinged closure according to claim 1, wherein said first and said second retaining sections are designed to achieve a form-fit connection.

5. The hinged closure according to claim 1, wherein said second retaining section and said engaging section are shaped to engage through a lock connection.

6. The hinged closure according to claim 1, wherein said first retaining section is located on a first wall of the lower part and said second retaining section is located on a second wall of the upper part.

7. The hinged closure according to claim 6, wherein said engaging section is located in said first or said second wall.

8. The hinged closure according to claim 1, wherein said second retaining section is at least partly elastically deformable.

9. The hinged closure according to claim 6, wherein the lower part defines a normal and wherein said first wall is inclined as compared to the lower part's normal by a first inclination angle $\alpha 1$ and said second wall of the upper part is inclined as compared to the lower part's normal by a second inclination angle $\alpha 2$.

10. The hinged closure according to claim 9, wherein said first inclination angle $\alpha 1$ and said second inclination angle $\alpha 2$ belong to a group of angles comprising the ranges 0 to 90°, 0 to 45°, 0 to 30°, 5 to 30°, 10 to 25°, 10 to 20°, 10 to 15°, 15 to 20°.

11. The hinged closure according to claim 1, wherein an opening angle in said second position belongs to a group of angles comprising the ranges 90 to 270°, 100 to 235°, 150 to 230°, 170 to 225°, 180 to 225°.

12. The hinged closure according to claim 1, wherein said lower part comprises an aperture area with an outlet port leading thereto, wherein the aperture area is formed as a hollow nozzle extending upwards from a sealing wall.

13. The hinged closure according to claim 1, wherein said upper part is designed as a flap-lid to cover an outlet port in the lower part.

14. The hinged closure according to claim 1, wherein the lower part comprises a drinking nozzle with an outlet port located therein.

15. The hinged closure according to claim 1, wherein the upper part is designed to seal an outlet port in the lower part fluid-proof.

16. The hinged closure according to claim 1, further comprising a tamper evidence device.

17. The hinged closure according to claim 16, wherein said tamper evidence device comprises a snatch belt designed to be fixed to the container and to be connected to the lower part by bond bridges shaped as predetermined breaking zones.

18. The hinged closure according to claim 16, wherein said tamper evidence device comprises a tearing strap connected to the upper or lower part by bond bridges shaped as predetermined breaking zones.

19. The hinged closure according to claim 17, wherein said snatch belt is designed to be detachably connected to the container.

20. The hinged closure according to claim 18, wherein the tamper evidence device comprises a protruding section designed to engage with said tearing strap.

21. A container, particularly a drinking bottle, equipped with a hinged closure according to claim 1.

* * * * *